US006801110B2

(12) United States Patent
Kolberg et al.

(10) Patent No.: US 6,801,110 B2
(45) Date of Patent: Oct. 5, 2004

(54) SPACER FOR THE SHUNT WIRES WITHIN A CIRCUIT BREAKER

(75) Inventors: Kenneth Daniel Kolberg, McKees Rocks, PA (US); Brian John Schaltenbrand, Cranberry Township, PA (US); Ramon Javier Ojeda, Imperial, PA (US); Ralph Mason Ennis, Imperial, PA (US); Arthur Dale Carothers, Beaver Falls, PA (US)

(73) Assignee: Eaton Corporation, Cleveland, OH (US)

( * ) Notice: Subject to any disclaimer, the term of this patent is extended or adjusted under 35 U.S.C. 154(b) by 45 days.

(21) Appl. No.: 10/161,511

(22) Filed: Jun. 3, 2002

(65) Prior Publication Data

US 2003/0222739 A1 Dec. 4, 2003

(51) Int. Cl.[7] ..... H01H 75/12

(52) U.S. Cl. ..... 335/35; 335/172; 335/6

(58) Field of Search ..... 335/6, 16, 23–25, 335/35–43, 147, 195, 165–176; 337/6

(56) References Cited

U.S. PATENT DOCUMENTS 4,620,076 A 10/1986 Mrenna et al.
5,870,008 A * 2/1999 Pannenborg et al. ..... 335/35
5,907,461 A 5/1999 Hartzel et al.
6,489,867 B1 * 12/2002 Turner et al. ..... 335/6

* cited by examiner

*Primary Examiner*—Lincoln Donovan
(74) *Attorney, Agent, or Firm*—Martin J. Moran

(57) ABSTRACT

A shunt wire spacer provides for proper spacing between the shunt wires extending from the movable arm to the bimetal within a circuit breaker, thereby ensuring that the shunt wires do not come together during over-current conditions within the circuit breaker, and preventing the shunt wires from interfering with the movement of the trip bar.

2 Claims, 5 Drawing Sheets

SPACER FOR THE SHUNT WIRES WITHIN A CIRCUIT BREAKER

BACKGROUND OF THE INVENTION

1. Field of the Invention

The present invention relates to circuit breakers. More specifically, the present invention provides a spacer for the shunt wires within the circuit breaker.

2. Description of the Related Art

A typical circuit breaker includes both a thermal trip mechanism and a magnetic trip mechanism for moving the arm having the movable contact away from the fixed contact when an over-current is present. The trip unit includes a bimetal connected at its fixed end to the load terminal, and at its free end to a shunt, which is connected to the contact arm. A trip bar mounted adjacent to the bimetal includes a thermal trip arm and a magnetic trip armature. The trip bar engages a latch on the operating mechanism for tripping the circuit breaker.

In use, current will flow from the line terminal, through the fixed contact, through the movable contact and arm, through the shunt, through the bimetal, and then through the load terminal. When a persistent low level over-current occurs, the heating of the bimetal will cause it to bend until it strikes the thermal trip arm of the trip bar, thereby tripping the circuit breaker. A larger over-current will cause the magnetic trip armature to be attracted toward the bimetal by a magnetic field generated by a short circuit current flowing through the bimetal, again rotating the trip bar and tripping the circuit breaker.

During a high interruption capacity test, it is possible for magnetic attraction caused by current flow in the same direction to cause the shunt wires to come together, thereby causing mechanical interference preventing movement of the thermal trip arm, thereby preventing tripping of the circuit breaker. Accordingly, there is a need for a means for maintaining proper spacing between the shunt wires to maintain proper function of the circuit breaker.

SUMMARY OF THE INVENTION

The present invention provides a shunt wire spacer for maintaining the proper distance between the shunt wires within a circuit breaker. The shunt wire spacer includes a pair of wire-receiving ends connected by a spacer portion. The shunt wire spacer may be made of any suitable material, such as metal or plastic. Because current in both shunt wires is flowing in the same direction, from the same origin destination, the conductive or insulative properties of the shunt wire spacer are not critical.

In use, the shunt wire spacer is inserted between the shunt wires, with each shunt wire within one of the two shunt wire receiving ends. With the shunt wire spacer in place, the shunt wires are held the proper distance apart to permit proper movement of the circuit breaker's thermal trip arm.

BRIEF DESCRIPTION OF THE DRAWINGS

Like reference numbers denote like elements throughout the drawings.

DETAILED DESCRIPTION

The present invention provides a spacer for use with the shunt wires of a circuit breaker, thereby maintaining the proper distance between these wires to permit proper tripping of the circuit breaker.

Figure 1:
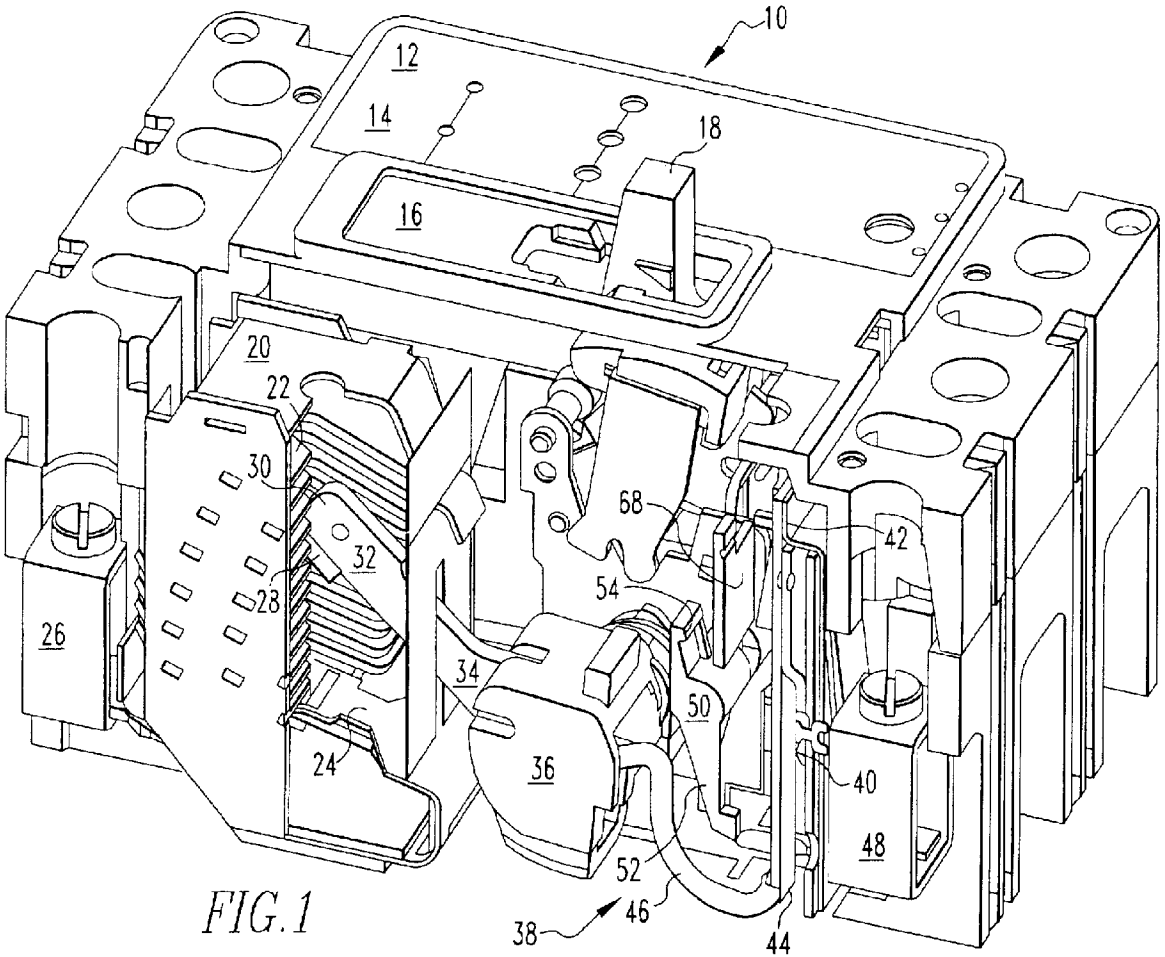
FIG. 1 is a cut-away isometric view of a circuit breaker for which the present invention will be used.
Figure 2:
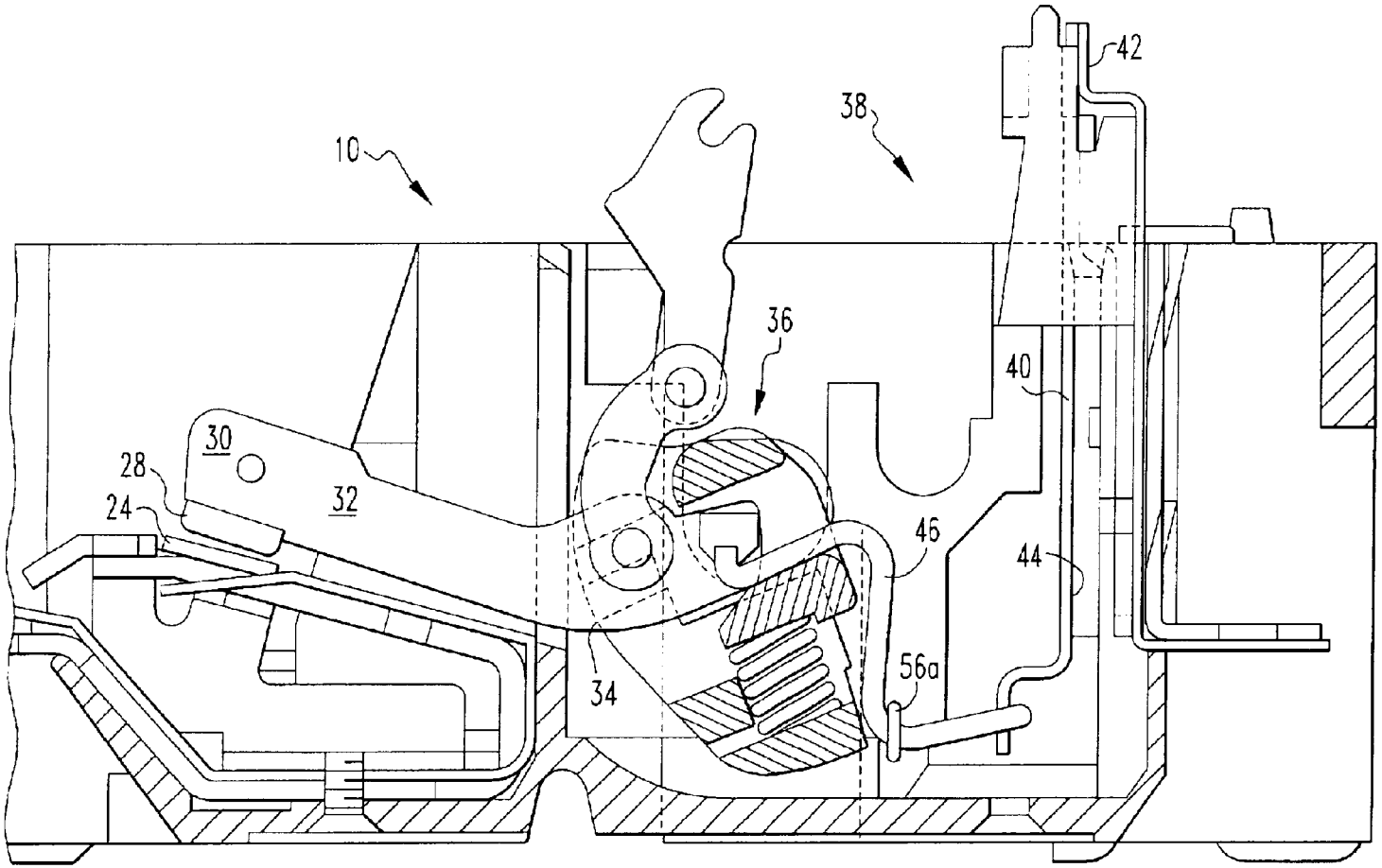
FIG. 2 is a cut-away side view of a circuit breaker with which the invention will be used.
Figure 3:
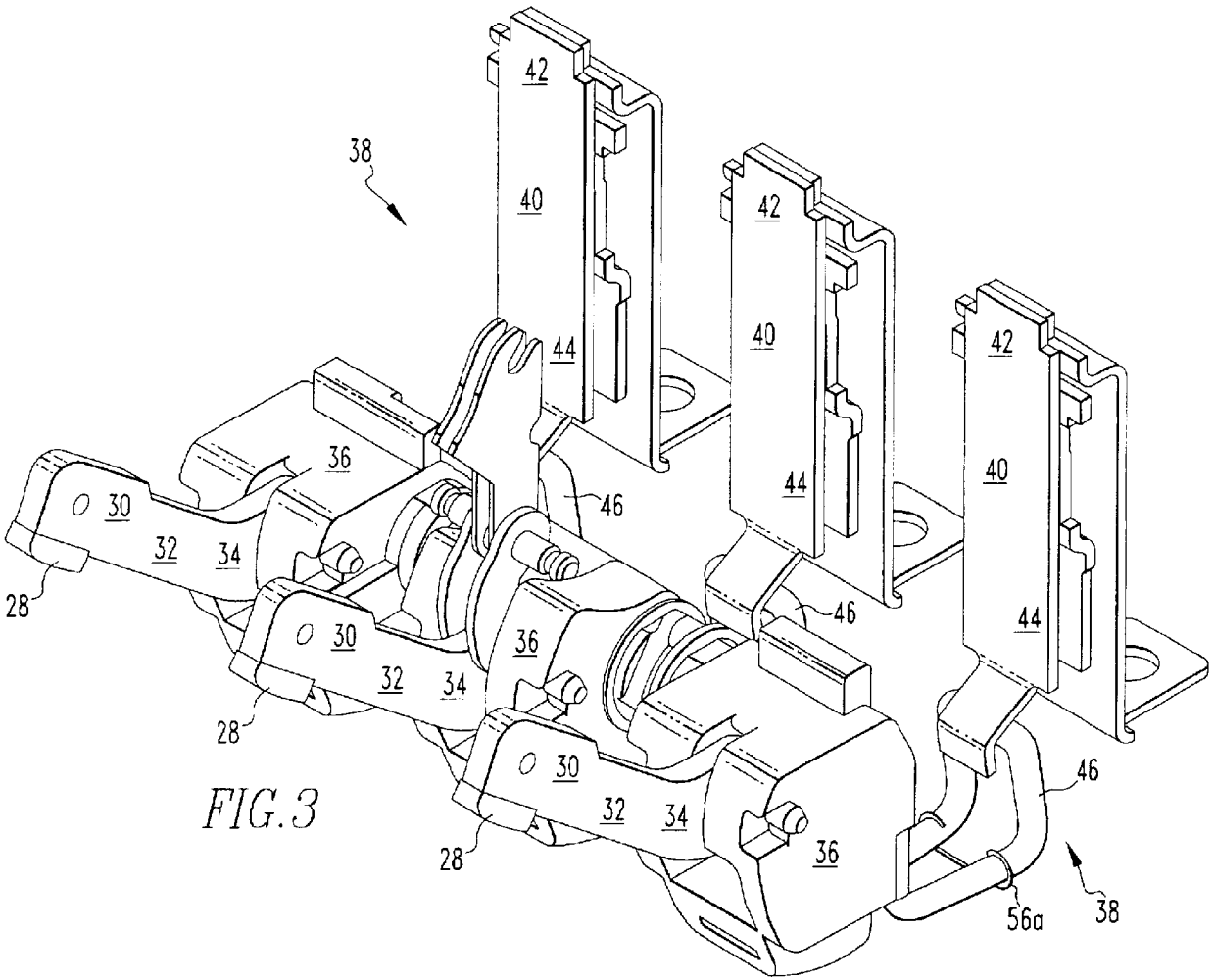
FIG. 3 is an isometric view of three contact arm carriers and their associated contact arms, shunt wires, bimetals, and shunt wire spacer, according to the present invention.

FIGS. 1–3 illustrate a circuit breaker 10 with which a shunt wire spacer of the present invention may be used. The circuit breaker 10 includes a housing 12 having a front face 14. The face 14 defines an opening 16, permitting the operating handle 18 to move therein between its open and closed positions.

The interior of the housing 12 includes three identical trip mechanisms, one of which will be described herein. Each trip mechanism includes an arc chamber 20 having a plurality of substantially parallel, spaced apart plates 22. A fixed electrical contact 24 is located at one end of the arc chamber 20, and is in electrical connection with the line terminal 26. A movable contact 28 is secured to the free end 30 of the arm 32. The pivoting end 34 of the arm 32 is housed within a contact arm carrier 36, which also includes a spring therein for holding the fixed 24 and movable 28 contacts together against the magnetic forces generated by the current flowing in opposite directions through these contacts. The operating handle 18 is operatively connected to the contact arm carrier 36, so that pivoting of the contact arm carrier 36 between the open position of the movable contact 28 (illustrated in FIG. 1) and the closed position of the movable contact 28 (illustrated in FIG. 2) may be controlled using the operating handle 18.

The circuit breaker includes a thermal-magnetic trip unit 38 for separating the contacts 24, 28 in response to an overcurrent. The thermal-magnetic trip unit 38 includes a bimetal 40 having a fixed end 42, and a free end 44. A pair of shunt wires 46 provide for electrical connection between the pivoting end 34 of the arm 32, and the free end 44 of the bimetal 40. The fixed end 42 of the bimetal 40 is electrically connected to the load terminal 48. When the circuit breaker 10 is closed, current may thereby flow through the line terminal 26, fixed contact 24, movable contact 28, arm 32, shunt wires 46, bimetal 40, and load terminal 48. A pivotally mounted trip bar 50 is also within the thermal magnetic trip unit 38, adjacent to the bimetal 40. The trip bar 50 includes a thermal trip arm 52, depending substantially perpendicular to the trip bar 50, and substantially parallel to the bimetal, and a magnetic trip armature 54, which in many preferred embodiments will be substantially parallel to the thermal trip arm 52. Both the thermal trip arm 52 and magnetic trip armature 54 are positioned adjacent to the bimetal 40. A persistent low level overcurrent within the bimetal 40 will cause the bimetal 40 to bend until it engages the thermal trip arm 52. A larger overcurrent will cause a magnetic attraction between the bimetal and the magnetic trip armature 54, thereby instantly rotating the trip bar 50 to bring the armature 54 toward the bimetal 40. It is well known in the art of circuit breakers that rotation of the trip bar 50 will release a latch that will permit the arm 32 and carrier 36 to be instantly spring-biased away from the fixed contact 24, thereby opening the circuit breaker. Additionally, the current flow in the fixed contact 24 and movable contact 28, being in opposite directions, will generate opposing magnetic forces sufficiently strong to overcome the spring within the carrier 36, causing the arm 32 to pivot with respect to the carrier 36, possibly before the pivoting of the carrier 36 would open the circuit breaker.

Figure 4:
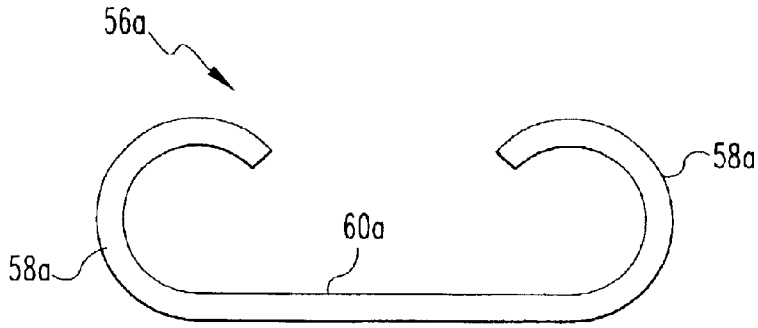
FIG. 4 is a front view of a shunt wire spacer according to the present invention.
Figure 5:
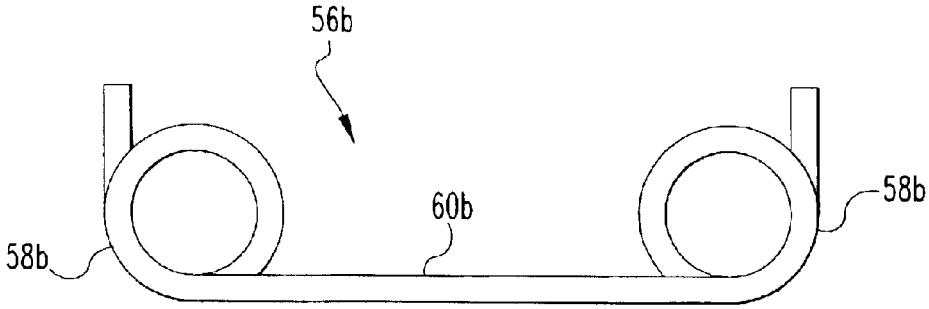
FIG. 5 is a front view of another embodiment of a shunt wire spacer according to the present invention.
Figure 6:
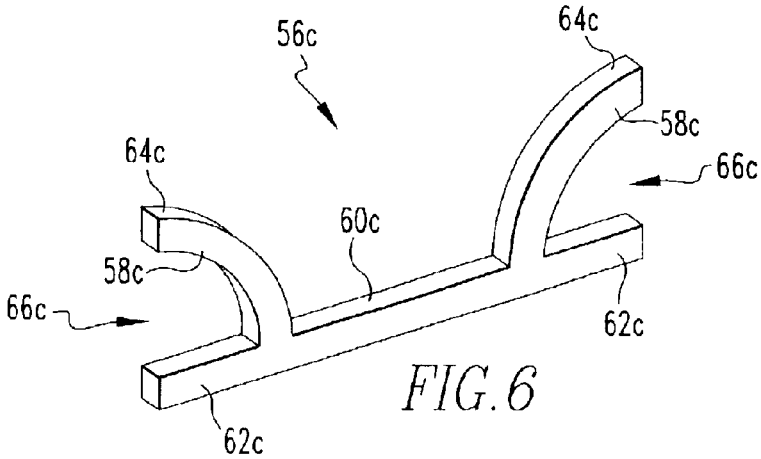
FIG. 6 is a front view of an alternative embodiment of a shunt wire spacer according to the present invention.

During a high interruption capacity test, it is possible for magnetic attraction caused by current flow in the same direction to cause the shunt wires to come together, thereby causing mechanical interference preventing movement of the thermal trip arm 52, thereby preventing proper tripping of the circuit breaker. Accordingly, the present invention provides a spacer 56 for the shunt wires 46. Some preferred embodiments of the shunt wire spacer 56 are illustrated in FIGS. 4–6. In describing these embodiments, a reference number utilized without a letter, will refer to all embodiments, a reference number followed by an A will refer to the embodiments of FIG. 4, a reference number followed by the letter B will refer to FIG. 5, and a reference number followed by the letter C will refer to FIG. 6.

The shunt wire spacer 56 includes a pair of ends 58, having a shunt wire receiving portion, and being connected by a connection portion 60 that is sufficiently rigid to hold the shunt wires 46 apart against the magnetic forces they generate. In the illustrated examples, the end portions 58A take the form of open-ended loops that partially encircle the shunt wires 46. The end portions 58B take the form of closed loops, completely circling the shunt wires 46. The example of FIG. 5 includes end portions 58C, defining a pair of prongs 62C, 64C, defining a shunt wire receiving channel 66C therebetween.

Figure 7:
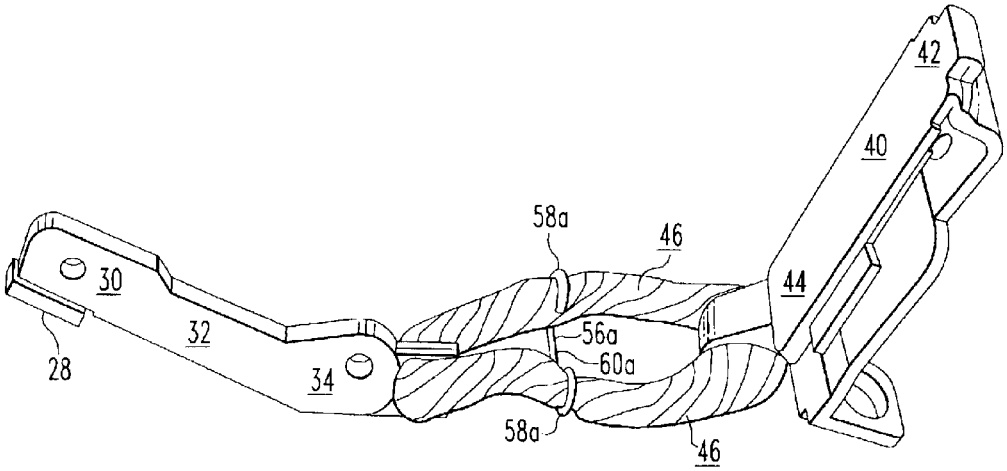
FIG. 7 is an isometric view of a movable contact arm, bimetal, connecting shunt wires, and shunt wire spacer according to the present invention.

Referring to FIGS. 2, 3, and 7, the shunt wire spacer 56A is illustrated holding the shunt wires 46 in the proper position. When current is passed through the wires, causing magnetic attraction between them, they will therefore not tend to be drawn together, as they would without the shunt wire spacer 56. Therefore, the shunt wires 46 will not interfere with the movement of the thermal trip arm 52.

The shunt wire spacer 56 may be made out of any material that is sufficiently rigid to keep the shunt wires 46 spaced a proper distance apart. Examples of preferred materials include metal, such as metal wire, and various plastics. Because current in both shunt wires 46 has the same potential, the shunt wire spacer 56 may be made out of an electrically conductive material without any danger of shorting the shunt wires 46. A preferred method of installing the shunt wire spacer 56A is to begin with the straight wire, and then bend the end portions of the wire 56A to encircle the shunt wires 46.

While a specific embodiment of the invention has been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A circuit breaker, comprising:

a movable contact arm having an electrical contact at a first end and being pivotally secured at a second end;

a bimetal having a fixed end and a free end;

a pair of shunt wires extending between said second end of said movable contact arm and said free end of said bimetal;

a shunt wire spacer having a pair of ends, each of said ends having a shunt-wire receiving portion, said ends being connected by a connection portion, said shunt wire spacer being sufficiently rigid to hold said shunt wires apart; and wherein the shunt wire spacer is made from metal wire.

2. A circuit breaker, comprising:

a movable contact arm having an electrical contact at a first end and being pivotally secured at a second end;

a bimetal having a fixed end and a free end;

a pair of shunt wires extending between said second end of said movable contact arm and said free end of said bimetal;

a shunt wire spacer having a pair of ends, each of said ends having a shunt-wire receiving portion, said ends being connected by a connection portion, said shunt wire spacer being sufficiently rigid to hold said shunt wires apart; and wherein the shunt wire spacer is made from plastic.

* * * * *